US005841072A

United States Patent [19]

Gagnon

[11] Patent Number: 5,841,072

[45] Date of Patent: Nov. 24, 1998

[54] DUAL INSULATED DATA COMMUNICATION CABLE

[75] Inventor: Gilles Gagnon, Ville Lorraine, Canada

[73] Assignee: B.N. Custom Cables Canada Inc., St-Chrysostome, Canada

[21] Appl. No.: 527,531

[22] Filed: Sep. 13, 1995

[30] Foreign Application Priority Data

Aug. 31, 1995 [CA] Canada ..... 2157322

[51] Int. Cl.[6] ..... H01B 7/28

[52] U.S. Cl. ..... 174/110 F; 174/121 A; 428/461

[58] Field of Search ..... 174/121 A, 110 FC, 174/110 PM, 110 F; 428/461, 421, 422

[56] References Cited

U.S. PATENT DOCUMENTS

| | | | |
|---|---|---|---|
| 3,176,065 | 3/1965 | Alexander et al. | 174/120 R |
| 3,571,490 | 3/1971 | Bunish et al. | 174/110 |
| 3,660,592 | 5/1972 | Anderson | 174/114 R |
| 3,676,566 | 7/1972 | McBride | 174/36 |
| 3,867,564 | 2/1975 | Kardashian | 174/36 |
| 4,079,191 | 3/1978 | Robertson et al. | 174/121 SR |
| 4,352,701 | 10/1982 | Shimba et al. | 174/110 PM |
| 4,595,793 | 6/1986 | Arroyo et al. | 174/121 A |
| 4,600,805 | 7/1986 | Glynn et al. | 174/102 R |
| 4,691,081 | 9/1987 | Gupta et al. | 174/105 R |
| 4,866,212 | 9/1989 | Ingram | 174/28 |
| 5,010,210 | 4/1991 | Sidi et al. | 174/34 |
| 5,015,800 | 5/1991 | Vaupotic et al. | 174/34 |
| 5,024,506 | 6/1991 | Hardin et al. | 385/102 |
| 5,043,530 | 8/1991 | Davies | 174/36 |
| 5,162,609 | 11/1992 | Adriaenssens et al. | 174/34 |
| 5,170,010 | 12/1992 | Aldissi | 174/36 |
| 5,173,960 | 12/1992 | Dickinson | 174/121 A |
| 5,202,946 | 4/1993 | Hardin et al. | 385/109 |
| 5,206,459 | 4/1993 | Aldissi | 174/36 |
| 5,210,377 | 5/1993 | Kennedy et al. | 174/107 |
| 5,220,130 | 6/1993 | Walters | 174/36 |
| 5,245,134 | 9/1993 | Vana, Jr. et al. | 174/117 F |
| 5,262,592 | 11/1993 | Aldissi | 174/36 |
| 5,281,766 | 1/1994 | Hildreth | 174/120 R |
| 5,293,001 | 3/1994 | Gebs | 174/36 |
| 5,304,739 | 4/1994 | Kloug et al. | 174/102 R |
| 5,313,017 | 5/1994 | Aldissi | 174/36 |
| 5,329,064 | 7/1994 | Tash et al. | 174/36 |
| 5,371,325 | 12/1994 | Kalola et al. | 174/117 R |
| 5,378,856 | 1/1995 | Allen | 174/120 R |
| 5,393,929 | 2/1995 | Yagihashi | 174/36 |
| 5,563,377 | 10/1996 | Arpin et al. | 174/121 A |
| 5,614,319 | 3/1997 | Wessels et al. | 174/110 FC X |

FOREIGN PATENT DOCUMENTS

| | | |
|---|---|---|
| 1164064 | 3/1984 | Canada . |
| 000258036 A | 3/1988 | European Pat. Off. . |
| 3337432 A1 | 4/1985 | Germany . |
| 5-325660 (A) | 12/1993 | Japan . |

OTHER PUBLICATIONS

*The Combustion of Organic Polymers,* C.F. Cullis and M.M. Hirschler, Clarendon Press, Oxford (1981) pp. 307–311.

*Primary Examiner*—Kristine L. Kincaid
*Assistant Examiner*—Marc D. Machtinger
*Attorney, Agent, or Firm*—Alix, Yale & Ristas, LLP

[57] ABSTRACT

A data communication cable for transmitting high frequency signals which includes at least one pair of conductors wherein each conductor is enclosed by a first inner layer of insulation and a second outer layer of insulation, and wherein the insulated conductors are enclosed by a jacket. The first inner layer of insulation is a polyolefin which may include a flame retardant and is in the form of an extruded expanded foam. The second or outer layer of insulation is a fluoropolymer and the jacket is a flame retardant and low-smoke PVC composition.

9 Claims, 1 Drawing Sheet

DUAL INSULATED DATA COMMUNICATION CABLE

FIELD OF THE INVENTION

This invention relates to data communication cable construction, but more particularly to communication cables adapted to operate at transmission frequencies of up to at least 100 Mbits/sec. and able to meet the plenum rating and electrical performance requirements.

BACKGROUND OF THE INVENTION

The National Electrical Code—NEC requires the use of metal conduits for communication cables installed in the return-air plenums of office buildings; an exception to this requirement is granted by NEC provided that such cables are approved as having low flame spread and smoke producing characteristics. In order to gain this approval, the cables are tested by independent laboratories in accordance to UL 910 and NFPA 262 Standard Test Methods for Fire and Smoke Characteristics of Cables Used in Air Handling Spaces and must pass its requirements.

In addition to the safety requirements mandated by the NEC articles, modern communication cables must meet electrical performance characteristics required for transmission at high frequencies. The required performance characteristics are specified by the ANSI/EIA-TIA specifications 568, TSB 36, TSB 40A, and SP-2840 draft revision covering for both unshielded and shielded twisted pair communication cables. These requirements, mainly the signal attenuation of the cable, have further limited the choice of the materials used in such cables namely: the insulation materials for the single conductors and, the jacketing materials.

Given the stringent requirements of the UL 910/NFPA 262 tests and the ANSI/EIA-TIA specifications listed above, few data communication cable constructions have qualified to date for installation in plenum spaces.

DESCRIPTION OF THE PRIOR ART

At the present time, the most economical materials suitable for cables meeting ANSI/EIA/TIA specifications and qualifying for plenum installation consist of the following combination:

Insulation: Fluorinated ethylene propylene copolymer (FEP); and

Jacket: Flame-retardant and low-smoke polyvinyl chloride based polymer alloys.

The use of FEP is a major inconvenience due to its high relative cost—up to 60% of the total cost—and limited availability.

As a way of reducing costs, some manufacturers have offered a cable construction comprising a mix of conductors. For example, with some conductors of a cable insulated with a single layer of fluoropolymer materials and others conductors in the same cable insulated with a single layer of PO materials. Although these can meet the requirements for plenum installation, such a cable design requires a high ratio of jacketing and fluoropolymer materials to the PO material.

In the same vein, use of a solid PO insulation as the first layer in a dual layer insulation cable construction may also require a high amount of jacketing and fluoropolymer materials in order to meet the requirements for plenum installation. Moreover, such a construction using large amounts of HALFR in PO layer should require even higher amounts of jacketing and fluoropolymer materials due to the known propensity of the HALFR additives to generate high level of smoke during combustion.

Thus such cable constructions as described above are still relatively costly to manufacture.

Use of highly flame-retardant polyolefin blends, with halogenated flame retardants (such as DBBO*) in excess of 25% and up to 40% in weight, have been considered. For example, U.S. Pat. No. 5,010,210 discloses a telecommunication cable wherein the wire insulation is made of a flame-retardant polyolefin-based compound. However, cable designs that include such highly flame-retardant polyolefins may fail to meet the peak smoke requirements of the UL 910/NFPA 262 flame and smoke test, although they should fully meet the ANSI/EIA-TIA specifications. One of the major reasons, for the expected failure to meet the peak smoke requirements of the UL 910/NFPA 262 test with such flame-retardant polyolefins, is the documented propensity of flame-retardant formulations containing halogenated flame-retardants to increase the smoke generation of the host polymer during combustion (see "M. M. HIRSCHLER, C. F. CULLIS, The Combination of Organic Polymers, Oxford Univ. Press—1981). It is also known that flame-retardant polyolefins are unlikely to meet the flame spread requirement of the UL 910/NFPA 262 flame and smoke test.

A need, therefore, exists for providing a data communication cable that will overcome the above shortcomings.

SUMMARY OF THE INVENTION

It is the object of the present invention to provide for a data telecommunication cable design alternative that reduces the need for FEP or other costly fluoropolymer alternative insulation materials for plenum UL 910/NFPA 262 test qualifications, while providing at the same time high-speed data transmission performance.

Another object of the present invention is to provide a cable design capable of qualifying for approved use in plenum spaces that use polyolefin insulating materials with little or no halogenated flame retardants.

Yet another object of the present invention is to provide a telecommunication cable design that meets the present ANSI/EIA-TIA specifications, in particular the signal attenuation for transmission frequencies of up to 100 Mbits/sec.

In accordance with the first aspect of the present invention, there is provided a data communication cable having at least a pair of insulated conductors and jacket surrounding the insulated conductors, comprising:

a dual layer conductor insulation having a first and second layer, said first layer being comprised of a polyolefin blend having less than 40% by weight of a halogenated flame retardant, said polyolefin blend being expanded into a foam during extrusion and said second layer being made of a fluoropolymer material; and a jacket surrounding the insulated conductors, wherein said jacket is made with a flame-retardant and low-smoke material.

In accordance with another aspect of the present invention, there is provided a data communication cable having at least four insulated conductors assembled in pairs and jacket surrounding the insulated conductors, comprising:

a dual layer conductor insulation having a first and second layer surrounding each conductor in a pair, said first layer being comprised of a polyolefin blend having less than 40% by weight of a halogenated flame retardant, said polyolefin blend being expanded into a foam during extrusion and said second layer being made of a fluoropolymer material; and a jacket surrounding the insulated conductors, wherein said jacket is made with a flame-retardant and low-smoke PVC alloy polymers wherein the sum of the weight-per-unit of length of fluoropolymer in the second layer and the PVC alloy jacket, divided by the weight-per-unit of length of the polyolefin blend in the first layer is greater than 11, whereby the fluoropolymer insulation layer can be reduced down to 0.0015 provided that the said ratio is greater than 11.

In accordance with another aspect of the invention, the material used for the second layer is selected from the group consisting of FEP, PFA, MFA, the blends thereof, and other fluoropolymers with high-flame retardancy having an oxygen index higher than 50 and low dielectric and dissipation constants.

In accordance with yet another aspect of the invention, the material used for the first layer is a commercially-available blend of chemical foam additives and carrier resin mixed in a polyolefin matrix containing a limited amount or no halogenated flame retardants.

BRIEF DESCRIPTION OF THE DRAWINGS

In order to impart full understanding of the manner in which these objects and others are attained in accordance with the present invention, the preferred embodiments thereof will be described hereinafter with reference to the accompanying drawings wherein.

DESCRIPTION OF THE PREFERRED EMBODIMENTS

In order to lighten the following description, the following acronyms will be used:

| Abbreviations | |
|---|---|
| FEP | Fluorinated Ethylene Propylene copolymer. |
| MFA | MethylFluoroAlkoxy fluorinated ethylene polymer. |
| PFA | PerFluoroAlkoxy fluorinated ethylene polymer. |
| PO | Polyolefin and blends thereof which includes: Polyethylene, polypropylene, polymethylpentene, etc. |
| HALFR | Halogenated flame retardants. |
| DBBO | Decabromodiphenyloxide. |
| NEC | National Electric Code |
| UL | Underwriters Laboratories |
| CSA | Canadian Standards Association |
| NFPA | National Fire Protection Association |
| ANSI | American National Standards Institute |
| EIA | Electronic Industries Association |
| TIA | Telecommunications Industry Association |
| TSB | Technical Systems Bulletin |
| Mbits/sec. | Megabits per second. |

Trademarks

PLENEX 1275, a trademark of Vista Co.
SMOKEGUARD 6920, a trademark of Alpha Gary Co.
TEKNOR APEX 910J, a trademark of Teknor Apex Co.

As indicated above, the present invention provides a cable design capable of qualifying for approved use in plenum spaces that use PO with little or no HALFR.

Figure 1A:
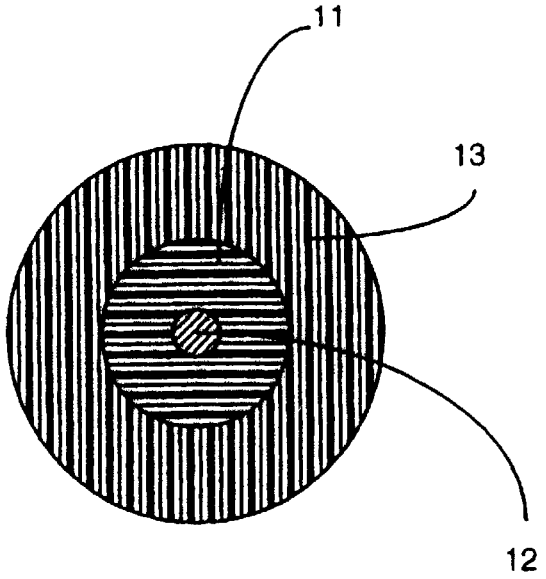
FIG. 1*a* is a schematic cross-sectional view of an insulated conductor with the dual insulation.

With reference to FIG. 1*a*, a schematic cross-section of a single insulated conductor is shown. The first layer 11 is an insulation which surrounds the central conductor 12, usually a copper conductor. The first layer consists of a PO with little or no HALFR that is expanded or foamed during the insulation or extrusion process. The terms expanded or foamed are commonly used in the industry to define a cellular like structure. The first layer of the composite dual insulation serves the purpose of reducing the usage of expensive FEP or other suitable fluoropolymers that is required under currently-approved plenum cable constructions. The foamed PO layer has uniform void cells distribution due to the blend of foam generating additives provided in commercially available PO blends.

The amount of void space in the first layer is in excess of 20%. Thus the first layer contains at equal linear length, less combustible and smoke-generating substance than with a solid layer made of PO. The potential for smoke-generation and flame-spread of the overall cable construction is then considerably reduced. At the same time, the electrical characteristics of the cellular polyolefin are considerably improved over its solid counterpart. Due to the lower dielectric constant and loss factor of the cellular layer, the attenuation of high-frequency digital signals is reduced to surpass the specified requirements of ANSI/EIA-TIA specifications.

A second layer 13 which surrounds the first layer is a fluoropolymer material which has very high-flame retardancy and low-smoke emission properties and also displays very low dielectric constant and dissipation factor. The materials that can be used for the second layer include fluoropolymers and/or blends thereof, such as FEP, PFA, MFA and other fluoropolymers having an oxygen index higher than 50 and low dielectric and dissipation constants. For example, FEP has a signal dissipation factor of 100 KHz of $<3\times10^{-4}$ and a dielectric constant of 2.1 at 100 Hz; MFA has a signal dissipation factor at 100 KHz of $<2\times10^{-4}$ and a dielectric constant of 1.95 at 100 Hz; and PFA has a signal dissipation factor at 100 KHz of $<2\times10^{-4}$ and a dielectric constant of 2.0 at 100 Hz.

The second layer materials were also chosen in function of their high melting temperatures and viscosities as compared with the first layer PO material.

In combustion, fluoropolymers melt at very high temperatures while retaining a high viscosity. This has the effect of slowing the burning rate of the underlining PO material which would normally feed the combustion process during a fire. This therefore results in a substantial reduction of smoke emission and flame spread.

Figure 1B:
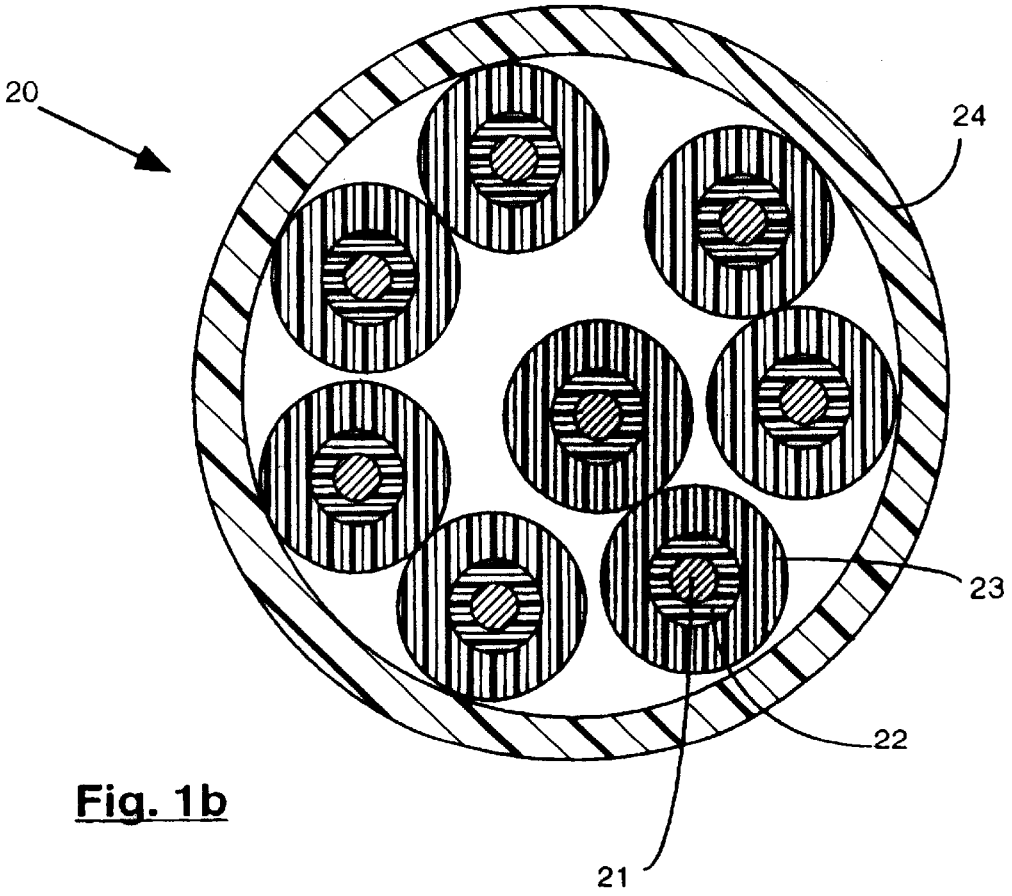
FIG. 1*b* is a schematic cross-sectional view of another embodiment of the invention.

With reference to FIG. 1*b*, we have shown in another embodiment of the present invention, a data communication cable 20 comprising a number of conductors 21 which are provided with a dual insulation formed by layer 22 and layer 23. The insulated conductors are assembled in pairs and are surrounded by a jacket 24 to provide low-peak and average smoke emissions and to limit flame spread when tested in accordance with the UL 910/NFPA 262 test. The jacketing materials which can be used are commercially available flame-retardant and low-smoke PVC materials such as PLENEX 1275™, SMOKEGUARD 6920™, and FIREGUARD 910J™ polyvinyl chlorides.

It was found that the concentration of halogenated flame-retardant additives in the polyolefin material, the thickness of jacketing material and the thickness of fluoropolymer material in the cable are interrelated and affect the overall flame and smoke retardancy of the proposed cable constructions.

In general, it was found that the greater the ratio between the total weight of fluoropolymer and jacketing materials to the weight of polyolefin with flame-retardants the better the flame and smoke retardancy of the resulting cable construction. Reductions in the amount of fluoropolymer and/or jacketing materials may result in increased smoke generation and UL 910/NFPA 262 test failures. However, reductions in the amount of fluoropolymer and jacketing materials may be compensated by a concomitant reduction in halogenated additives and/or the quantity of polyolefin material in the first layer.

The discovery of the above relationship has permitted the design of cost-effective cable constructions that meet all the required safety and data transmission standards.

In two cable constructions, the amount of fluoropolymer was kept constant while all other material components were varied. In a third construction, the amount of fluoropolymer was increased slightly. The UL 910/NFPA 262 flame and smoke test results with three cable constructions were as follows:

| | PEAK OPTICAL SMOKE DENSITY | AVERAGE OPTICAL SMOKE DENSITY | FLAME SPREAD |
|---|---|---|---|
| REQUIREMENTS | 0.50, MAXIMUM | 0.15, MAXIMUM | 5.0 FT, MAX. |
| TEST RESULTS, CABLE I | 0.56 | 0.09 | 3.7 FT |
| TEST RESULTS, CABLE II | 0.39 | 0.08 | 1.8 FT |
| TEST RESULTS, CABLE III | 0.37 | 0.06 | 3.3 FT |

The weight ratios between the material components of the above cable constructions are as follows:

| CABLE DESIGN | CABLE 1 | CABLE II | CABLE III |
|---|---|---|---|
| UL 910 / NFPA 262 SMOKE TEST RESULTS: | FAIL | PASS | PASS |
| FLUOROPOLYMER: Relative weight/unit length cable | 1.0 | 1.0 | 1.08 |
| PO WITH DBBO: Relative weight/unit length cable | 1.0 | 0.78 | 0.74 |
| PVC JACKET: Relative weight/unit length cable | 1.0 | 1.37 | 1.10 |
| HALOGENATED ADDITIVES, DBBO: Relative weight/unit length cable | 1.0 | 0.74 | 0.14 |
| FLUOROPOLYMER/(PO + DBBO) | 2.8 | 3.6 | 4.1 |
| PVC JACKET/(PO + DBBO) | 7.3 | 12.7 | 10.8 |
| (FLUOROPOLYMER + PVC JACKET)/(PO + DBBO) | 10.1 | 16.3 | 14.9 |
| % DBBO in (PO + DBBO) | 32.5 | 30.8 | 6.4 |

Based on the above findings, it is derived that in order to meet the UL 910/NFPA 262 smoke and flame tests and the ANSI/EIA-TIA specifications for data transmission of up to 100 Mbits/sec., the sum of the weight per unit of length of the fluoropolymer and the weight per unit of length of the PVC material, divided by the weight per unit of length of the PO foam should exceed 11. It was found that at a ratio of 14 to 17, resulting cable designs will very safely meet UL 910/NFPA 262 smoke and flame tests requirements as demonstrated with cable II and cable III designs.

In cable I and II designs, the amount of fluoropolymer per unit weight was kept constant. However, in cable II design, the amount of PO was reduced by causing a higher level of expansion in the first layer while maintaining the ratio of PO to HALFR additive the same as in the cable I design.

The increase in the ratio (Fluoropolymer+PVC Jacket)/(PO+DBBO) to 16.3 for the cable II design was obtained by increasing the amount of PVC alloy jacketing material. This strategy has permitted a reduction in the amount of fluoropolymer; thus the cost of the successful design was also reduced, considering that the cost of the fluoropolymer material is 4.7 times that of PVC material per unit of cable length.

In cable III design, the amount of fluoropolymer per unit length was only slightly increased (by 8.1%). The PO was also slightly reduced, but the amount of HALFR additives was only 21% of the amount found in cable II design. The amount of PVC material was also reduced to 80% of the amount found in cable II design. The resulting cable III design has shown the best peak and average smoke results.

The above results suggest a method for the optimization of premise wire cables cost per unit length. In particular, one could maintain a ratio of around 14 between the sum of the quantities of the fluoropolymer and the PVC material to the quantity of PO in the first layer by:

(a) Increasing the expansion of PO in the first layer.

(b) Increasing the PVC alloy jacket thickness (quantity per unit length).

(c) Decreasing the fluoropolymer layer; however, the fluoropolymer layer should be at least 0.0015 inch thick.

Preferrably, the HALFR should be kept at or less than 7% of the PO and HALFR weight per unit of length, or be eliminated altogether.

Both the reduction of the HALFR and, especially, the reduction of the fluoropolymer material contribute greatly towards a parallel reduction of the premise wire unit length cost.

It was also found that a cable with a PO cellular first layer that contains less than 7% of the HALFR additives, and a fluoropolymer second layer, as in the above-mentioned cable III design, had insulation crush resistance results of 750 lbs. as compared to the requirement of the UL-444 and CSA C22.2 No. 214 standards at 300 lbs, minimum. Insulation crush resistance of cable design II was only at 325 lbs., while the amount of HALFR additives in the first layer exceeded 30%. These results show that the reduction in HALFR additives concentration permits a higher gas expansion ratio in the PO layer without compromising the crush resistance requirements. The higher gas expansion ratio allows for the design of cables with smaller dimensions of both the insulation layers and the jacket, thereby achieving substantial cost reductions.

Variations of the particular embodiment herewith described will be obvious to one skilled in the art, and accordingly the embodiment is to be taken as illustrative rather than limitive, the true scope of the invention being set out in the appended claims.

The embodiments of the invention in which an exclusive property or privilege is claimed are defined as follows:

1. A data communication cable for transmitting high-frequency signals with low signal attenuation, comprising:

at least one pair of conductors;

a first insulation layer surrounding and enclosing each of said conductors, said first insulation layer comprising an expanded polyolefin foam containing 0% to 40% by weight of a halogenated flame-retardant;

a second insulation layer surrounding and enclosing each said first insulation layer, said second insulation layer comprising a fluoropolymer having a signal dissipation factor less than about $3\times10^{-4}$ and a dielectric constant less than about 2.1 at high frequencies; and a jacket surrounding and enclosing said conductors provided with said first and second insulation layers, said jacket comprising a material having flame-resistant and smoke-suppressive properties.

2. A data communication cable as defined in claim 1, wherein said expanded polyolefin foam comprises a blend of polyolefins with less than 15% by weight of said halogenated flame retardant.

3. A data communication cable as claimed in claim 2, wherein said fluoropolymer has an oxygen index higher than 50.

4. A data communication cable as defined in claim 3, wherein said second layer has a thickness of 0.0015 inch or greater.

5. A data communication cable as defined in claim 2, wherein said expanded polyolefin foam is at least 20% void and has a uniform distribution of cells.

6. A data communication cable as defined in claim 2, wherein said jacket comprises a flame-retardant and low-smoke polyvinyl chloride.

7. A data communication cable as defined in claim 6, wherein the sum of the weight-per-unit of length of said fluoropolymer and said polyvinyl chloride, divided by the weight-per-unit of length of said polyolefin foam is greater than 11, whereby the second insulation layer has a thickness of about 0.0015 inch.

8. A data communication cable as defined in claim 3, wherein said fluoropolymer is selected from the group consisting of fluorinated ethylene-propylene copolymers, perfluoroalkoxy fluorinated ethylene polymers and methylfluoroalkoxy fluorinated ethylene polymers.

9. A data communication cable for transmitting high-frequency signals with low signal attenuation, comprising:

at least one pair of conductors;

a first insulation layer surrounding and enclosing each of said conductors, said first insulation layer comprising an expanded polyolefin foam containing 0% to 40% by weight of a halogenated flame-retardant;

a second insulation layer surrounding and enclosing each said first insulation layer, said second insulation layer comprising a fluoropolymer having a signal dissipation factor less than about $3\times10^{-4}$ and a dielectric constant less than about 2.1 at high frequencies; and a jacket surrounding and enclosing said conductors provided with said first and second insulation layers, said jacket comprising a polyvinyl chloride material having flame-resistant and smoke-suppressive properties;

wherein the sum of the weight-per-unit length of said fluoropolymer and said polyvinyl chloride material, divided by the weight-per-unit length of said polyolefin foam is greater than 11, whereby said second insulation layer has a thickness of about 0.0015 inch.

* * * * *